United States Patent [19]

Peck et al.

[11] 3,953,320

[45] Apr. 27, 1976

[54] CRACKING-ISOMERIZATION PROCESS

[75] Inventors: Reese A. Peck, Fishkill; Li C. Mih, Wappingers Falls; John T. Brandenburg, Hopewell Junction, all of N.Y.

[73] Assignee: Texaco Inc., New York, N.Y.

[22] Filed: May 16, 1974

[21] Appl. No.: 470,687

[52] U.S. Cl. ..... 208/111; 208/138; 208/139; 208/141; 252/455 Z

[51] Int. Cl.[2] ..... C10G 13/02; B01J 29/22

[58] Field of Search ..... 208/111, 138, 139, 141

[56] References Cited

UNITED STATES PATENTS

| | | | |
|---|---|---|---|
| 3,516,925 | 6/1970 | Lawrance et al. | 208/111 |
| 3,544,451 | 12/1970 | Mitsche et al. | 208/139 |
| 3,562,148 | 2/1971 | Mitsche | 208/139 |
| 3,574,092 | 4/1972 | Mitsche | 208/139 |
| 3,702,293 | 11/1972 | Hayes et al. | 208/139 |
| 3,707,460 | 12/1972 | Bertolacini et al. | 208/65 |
| 3,821,105 | 6/1974 | Mitsche et al. | 208/139 |

*Primary Examiner*—Delbert E. Gantz
*Assistant Examiner*—G. E. Schmitkons
*Attorney, Agent, or Firm*—T. H. Whaley; C. G. Ries; Robert Knox, Jr.

[57] ABSTRACT

The octane number of a hydrocarbon fraction boiling below 425°F is improved by a cracking-isomerization procedure. The $C_5$+ portion of the resulting product may be used as a motor fuel or as a blending component for motor fuels.

9 Claims, No Drawings

CRACKING-ISOMERIZATION PROCESS

This invention relates to the production of motor fuel components. More particularly, it is concerned with a cracking-isomerization process for improving the octane number of liquid hydrocarbon fractions boiling up to about 425°F.

It is well known that many hydrocarbon fractions boiling in the motor fuel range must be upgraded to provide a satisfactory motor fuel, that is, one having an octane number of at least about 90. For the past several decades, the octane number of motor fuels has been increased by the addition of TEL. However, because of current day environmental exigencies, it has been proposed to eliminate the use of TEL as a motor fuel additive. Thus, it is now becoming necessary to convert many low octane fractions into high octane motor fuels or motor fuel blending components by refinery processing techniques rather than by the use of lead-containing octane improvers. One of the most popular methods of upgrading a straight-run motor fuel fraction is catalytic reforming, a procedure whereby naphthenes are dehydrogenated and aromatized to convert the naphthenes into high octane aromatic compounds. This procedure generally involves relatively high temperatures and pressures. Conventionally, the feed to a catalytic reforming unit has been a heavy straight-run naphtha, that is, a straight-run fraction having a boiling range of about 250°–425°F. Ordinarily the light straight-run naphtha could be blended into higher octane components and with the addition of TEL could provide a satisfactory motor fuel. However, with the elimination of the use of TEL it has now become necessary to upgrade the light straight-run naphtha. Another material which could be improved is the raffinate obtained by extracting the aromatics from a product such as a catalytic reformate. Such raffinates have a high n-paraffin content and correspondingly have a low octane number. We have now discovered a low temperature, low pressure process, in which the principal reactions are cracking and isomerization, whereby a low octane hydrocarbon liquid may be converted into a high octane motor fuel or a blending component for motor fuels.

According to our invention the octane number of a hydrocarbon liquid boiling below about 425°F. is improved by contacting it at a temperature between about 550° and 750°F. and a pressure between about 40 and 500 psig in the presence of added hydrogen with a catalyst comprising a noble metal on a support comprising an acid-leached mordenite having a silica:alumina mole ratio between 20 and 100:1.

The charge to the process of our inventon may be any low octane hydrocarbon liquid boiling below about 425°F. such as straight-run naphtha or the raffinate obtained by the extraction of aromatic compounds from a reformate produced by the catalytic reforming of heavy straight-run naphtha. These fractions typically are high in normal paraffin content and low in isoparaffin and aromatic content. In this context a low octane fraction is one having an unleaded research octane number of less than 70 whereas that of a blending component should be at least 80.

The catalyst used in the process of our invention comprises a noble metal, e.g., platinum, palladium, rhodium or iridium on a support comprising mordenite having a high silica:alumina ratio the nobel metal may be present in an amount between about 0.1 and 5.0 wt. % based on the catalyst composite, a preferred amount being between 0.5 and 2.0 wt. %. The balance of the catalyst comprises mordenite having a high silica:alumina mole ratio ranging from 20 to 100:1 preferably from 40 to 80:1 advantageously composited with an amorphous refractory inorganic oxide.

Mordenite is a crystalline aluminosilicate which occurs naturally or may be prepared synthetically. Typically it has an analysis of approximately 7.0 wt. % $Na_2O$, 10 wt. % $Al_2O_3$ and 68.0 wt. % $SiO_2$ with an average $SiO_2$:$Al_2O_3$ mol ratio of between about 10 and 12:1. To produce a suitable catalyst support the mordenite is treated with dilute acid, e.g. 6N HCl until the $SiO_2$:$AlO_3$ mole ratio is raised to 20:1. Additional leaching increases the silica:alumina mole ratio. Advantageously, the acid-leached mordenite is composited with up to about 50% of a refractory inorganic oxide such as alumina, silica, magnesia, titania and the like.

The noble metal may be deposited on the support by impregnating the acid-leached mordenite with a solution of a soluble compound of the metal, drying and then calcining in a manner well known in the art.

The catalyst may be used as a slurry or as a moving or fixed bed of catalyst particles. Preferably, the catalyst is used as a fixed bed of particles having a cylindrical shape with a maximum dimension of ½ inch.

The hydrogen used in the process of our invention need not necessarily be pure. It should, however, have a purity of at least about 60% and preferably between about 70 and 95%. Suitable sources of hydrogen are catalytic reformer by-product hydrogen, electrolytic hydrogen and hydrogen produced by the partial oxidation of carbonaceous fuels followed by shift conversion and $CO_2$ removal. Hydrogen flow through the catalyst bed may be upward or downward in concurrent flow with the charge stock or may be upward countercurrent to downwardly flowing charge stock. In a preferred embodiment both the charge stock and the hydrogen are passed downwardly through a fixed bed of catalyst particles.

As mentioned above, the process of out invention employs relatively low temperatures and pressures. The cracking-isomerization process of our invention may be conducted at a temperature between about 550° and 750°F. preferably between 600° and 700°F. Pressures may range between about 40 and 500 psig, a preferred range being between about 50 and 250 psig. The charge stock may be passed through the catalyst bed at a space velocity between about 0.1 and 10 volumes of oil per volume of catalyst per hour preferably between 0.5 and 5 v/v/hr. Hydrogen is introduced into the reaction zone at a rate between about 500 and 10,000 scfb, a preferred rate being between 1000 and 7000 scfb.

The following examples are given for illustrative purposes only and it should not be construed that the invention is restricted thereto.

EXAMPLE I

In this example the catalyst is prepared by leaching mordenite several times with 6N HCl to produce a mordenite having a silica:alumina mol ratio of 72:1. The mordenite is then impregnated with a solution of chloroplatinic acid sufficient to provide a platinum concentration of 0.75 wt. % based on the catalyst composite. After drying at 200°F. and calcining at 1000°F., the impregnated mordenite is extruded into 1/16 inch pellets.

The charge is a light straight-run naphtha containing 3% aromatics, 3.5% olefins and 93.5% saturates by volume. The $C_4$–$C_5$ content is as follows: $i$-$C_4$ 0.8 wt. %, $n$-$C_4$ 4.2 wt. %, $i$-$C_5$ 8.6 wt. % and $n$-$C_5$ 12.7 wt. %. The ASTM distillation range is tabulated below:

Table 1

| ASTM dist. °F. | |
|---|---|
| IBP–10% | 86–115 |
| 20–30% | 125–135 |
| 40–50% | 145–155 |
| 60–70% | 165–176 |
| 80–90% | 187–201 |
| 95–EP | 212–239 |

The research octane number, clear, of the $C_5$+ portion of the charge is 69.3. The charge is passed through a fixed bed of the pelleted catalyst at a pressure of 200 psig, a temperature of 650°F., a space velocity of 1.07 v/v/hr. and a hydrogen rate of 4958 scfb. The $C_4$–$C_5$ content of the product is $i$-$C_4$ 27.3 wt. %, $n$-$C_4$ 11.7 wt. %, $i$-$C_5$ 14.0 wt. % and $n$-$C_5$ 5.1 wt. %. The product also contains 29.8 wt. % propylene and the research octane number, clear, of the $C_5$+ product is 88.5.

The above example shows the conversion of light straight-run naphtha into high yields of $C_4$–$C_5$ hydrocarbons and particularly to the more desirable isobutane and isopentanes.

By way of comparison, when the same charge stock is contacted under substantially the same reaction conditions with a catalyst containing 0.75 wt. % platinum on hydrogen mordenite having an alkali metal content of 0.7 wt. % and a silica:alumina mol ratio of 15:1, the $C_4$–$C_5$ content of the product is $i$-$C_4$ 21.8 wt. %, $n$-$C_4$ 12.6 wt. % $i$-$C_5$ 9.9 wt. % and $n$-$C_5$ 3.9 wt. % and the research octane number, clear, of the $C_5$+ portion of the product is 78.5.

However, in a run using the same charge stock as in Example I and the same reaction conditions but using a catalyst composed of 0.45 wt. % platinum on acid-leached mordenite having a silica:alumina mole ratio of 25:1, the $C_5$+ portion of the product has a research octane number, clear, of 82.

EXAMPLE II

In this example the catalyst is prepared by a procedure similar to that used in Example I. However, prior to pelleting, alumina gel is incorporated into the platinum on mordenite catlyst so that the final composition is platinum 0.75 wt. %, alumina 15 wt. % and the balance mordenite having a 72:1 silica:alumina mole ratio. The charge is a paraffinic raffinate obtained by extracting the aromatics from a catalytic reformate. It contains 82.4 vol. % paraffins, 0.9 vol. % olefins, 4.7 vol. % naphthenes and 12 vol. % aromatics. Its ASTM distillation range is tabulated below.

Table 2

| ASTM dist. °F. | |
|---|---|
| IBP–10% | 237–252 |
| 20%–30% | 255–258 |
| 40%–50% | 262–266 |
| 60%–70% | 272–278 |
| 80%–90% | 288–305 |
| 95%–EP | 327–362 |

Its research octane number, clear, is 36.0

The charge is passed through a fixed bed of the catalyst at 700°F., 50 psig, 1.0 v/v/hr. with hydrogen at a rate of 6761 SCFB. The $C_4$–$C_5$ content of the product is $i$-$C_4$ 25.4 wt. %, $n$-$C_4$ 14.3 wt. %, $i$-$C_5$ 13.7 wt. % and $n$-$C_5$ 9.1 wt. %. The research octane number clear of the $C_5$+ portion of the product is 100. Comparable results are obtainable with platinum-mordenite catlysts containing up to 50 wt. % alumina.

Example II shows the conversion of a low octane paraffinic fraction to good yields of isobutane and isopentane and also to a high octane motor fuel. These results also show that the cycloparaffins and aromatics present in the charge are not cracked as evidenced by the high octance number of the $C_5$+ product. The isobutane and isopentane produced by our process may be used as alkylation feed stocks or may be added to the gasoline pool. The $C_5$+ portion of the product may also be used for blending to produce high octane gasoline free of tetra ethyl lead.

By way of comparasion, when the same charge used in Example II is passed through a bed of commercially-obtained platinum on alumina catalyst containing 0.6 wt. % platinum at 750°F., 200 psig, 1.0 v/v/hr. with hydrogen at rate of 5970 SCFB, the $C_4$–$C_5$ content of the product is $i$-$C_4$ 1.1 wt. %, $n$-$C_4$ 0 wt. %, $i$-$C_5$ 0 wt. % and $n$-$C_5$ 0.9 wt. %. The research octane number, clear, of the $C_5$+ portion of the product is 53.0. This comparative run shows that even with conditions more severe than in Example II, the platinum on alumina catlyst contaiing no mordenite has relatively little effect on the charge.

Obviously, various modifications of the invention as hereinbefore set forth may be made without departing from the spirit and scope thereof, and therefore, only such limitations should be made as are indicated in the appended claims.

We claim:

1. A process for improving the octane number of a hydrocarbon liquid fraction boiling below about 425°F. by a cracking-isomerization procedure which comprises contacting said fraction at a temperature between about 550° and 750°F. and a pressure between about 40 and 500 psig in the presence of added hydrogen with a catalyst comprising a noble metal on a support comprising at least 50% by weight acid-leached mordenite having a silica-alumina mol ratio of between about 40 and 80:1.

2. The process of claim 1 in which the noble metal is platinum.

3. The process of claim 1 in which the pressure in the cracking-isomerizatoin zone is between 50 and 250 psig.

4. The process of claim 1 in which the fraction boiling below 425°F. has an octane number of less than 70.

5. The process of claim 4 in which the hydrocarbon fraction is a light straight-run naphtha having an end boiling point of about 250°F.

6. The process of claim 4 in which the hydrocarbon fraction is a catalytic reformate from which a substantial portion of the aromatics have been removed.

7. The process of claim 1 in which the support comprises an anhydrous refractory inorganic oxide.

8. The process of claim 1 in which the catalyst comprises from 0 to 50 wt. % alumina.

9. The process of claim 1 in which the temperature in the cracking-isomerization zone is between 600 and 700°F.

* * * * *